US007930966B1

(12) United States Patent
Bhatnagar et al.

(10) Patent No.: US 7,930,966 B1
(45) **Date of Patent: *Apr. 26, 2011**

(54) SPACED LIGHTWEIGHT COMPOSITE ARMOR

(75) Inventors: Ashok Bhatnagar, Richmond, VA (US); David A. Hurst, Richmond, VA (US); Brian D. Arvidson, Chester, VA (US); Lori L. Wagner, Richmond, VA (US)

(73) Assignee: Honeywell International Inc., Morristown, NJ (US)

( * ) Notice: Subject to any disclaimer, the term of this patent is extended or adjusted under 35 U.S.C. 154(b) by 6 days.

This patent is subject to a terminal disclaimer.

(21) Appl. No.: 12/815,516

(22) Filed: Jun. 15, 2010

Related U.S. Application Data

(63) Continuation of application No. 11/606,522, filed on Nov. 30, 2006, now Pat. No. 7,762,175.

(51) Int. Cl.
*F41H 5/04* (2006.01)
*B32B 23/02* (2006.01)

(52) U.S. Cl. ..... 89/36.02; 89/906; 89/910; 89/914; 109/49.5; 428/190

(58) Field of Classification Search ..... 89/36.02; 109/49.5; 428/190, 911
See application file for complete search history.

(56) References Cited

U.S. PATENT DOCUMENTS

| | | | | |
|---|---|---|---|---|
| 3,894,472 | A | 7/1975 | Davis | 89/36.02 |
| 4,919,037 | A | 4/1990 | Mitchell | 89/36.05 |
| 5,480,706 | A | 1/1996 | Li et al. | 428/113 |
| 5,545,455 | A | 8/1996 | Prevorsek et al. | 428/76 |
| 5,591,933 | A | 1/1997 | Li et al. | 89/36.02 |
| 6,103,641 | A | 8/2000 | Gehring, Jr. | 442/46 |
| 6,370,690 | B1 | 4/2002 | Neal | 2/2.5 |
| 6,642,159 | B1 | 11/2003 | Bhatnagar et al. | 442/134 |
| 6,647,856 | B1 | 11/2003 | Neal | 89/36.02 |
| 6,899,009 | B2 | 5/2005 | Christiansen et al. | 89/36.02 |
| 7,216,576 | B2 | 5/2007 | Henry et al. | 89/36.02 |
| 7,331,270 | B2 | 2/2008 | Booher | 89/36.02 |
| 7,762,175 | B1 * | 7/2010 | Bhatnagar et al. | 89/36.02 |
| 2005/0193667 | A1 | 9/2005 | Henry et al. | 52/309.9 |
| 2008/0139071 | A1 | 6/2008 | Bhatnagar et al. | 442/414 |

FOREIGN PATENT DOCUMENTS

WO WO8901125 2/1989

* cited by examiner

*Primary Examiner* — Bret Hayes
(74) *Attorney, Agent, or Firm* — Erika S. Wilson

(57) ABSTRACT

Lightweight, ballistic resistant articles are provided. More particularly, armor structures incorporating two or more spaced apart, ballistic resistant panels, having superior impact and ballistic performance at a light weight. The panels are spaced by air or by an intermediate material.

20 Claims, 2 Drawing Sheets

SPACED LIGHTWEIGHT COMPOSITE ARMOR

CROSS-REFERENCE TO RELATED APPLICATION

This application is a continuation of application Ser. No. 11/606,522 filed Nov. 30, 2006, now U.S. Pat. No. 7,762,175, the entire disclosure of which is incorporated by reference herein.

BACKGROUND OF THE INVENTION

1. Field of the Invention

The invention relates to lightweight, ballistic resistant structures. More particularly, the invention pertains to armor structures incorporating two or more spaced apart, ballistic resistant panels, having superior impact and ballistic performance at a light weight.

2. Description of the Related Art

Ballistic resistant articles containing high strength fibers that have excellent properties against projectiles are well known. High strength fibers conventionally used include polyolefin fibers, such as extended chain polyethylene fibers, and aramid fibers, such as para- and meta-aramid fibers. For many applications, the fibers may be used in a woven or knitted fabric. For other applications, the fibers may be encapsulated or embedded in a matrix material to form non-woven rigid or flexible fabrics.

Various ballistic resistant constructions are known that are useful for the formation of hard or soft armor articles such as helmets, structural panels and ballistic resistant vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

Current armor structures are fabricated and installed as a single sheet of fabric armor material with optional steel or ceramic plate facings. As increasing ballistic resistance requirements are met, significant weight is typically added to such armor structures as the materials are made thicker to enhance the ballistic resistance properties. There is a need in the art for a means to increase ballistic resistance properties of armor without adding significant weight to the structure. The present invention provides a solution to this need. Particularly, the invention provides armor structures including two or more connected but spaced apart, ballistic resistant panels, having superior impact and ballistic performance at a light weight. When a high speed projectile hits the first armor panel, the projectile is deformed and slowed down prior to reaching the second armor panel. When the second armor panel is hit, the projectile is either slowed down further, or stopped. The spaced configuration reduces backface deformation compared to a configuration where multiple panels are directly bonded together. Also, an improvement in ballistic resistance allows lower weight structures to be used to maintain the superior ballistic resistance properties achieved with higher weight materials.

SUMMARY OF THE INVENTION

The invention provides a ballistic resistant article comprising:

a) a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and b) a second panel connected to the first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and c) wherein the first panel and the second panel are connected by a connector instrument such that they are positioned spaced apart from each other by at least about 2 mm.

The invention also provides a method of forming a ballistic resistant article which comprises:

a) providing a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition;

b) connecting a second panel to said first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition, and wherein the first panel and the second panel are connected by a connector instrument such that they are positioned spaced apart from each other by at least about 2 mm.

The invention further provides a reinforced object which comprises an object coupled with a ballistic resistant article, the ballistic resistant article comprising:

a) a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and b) a second panel connected to the first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and c) wherein the first panel and the second panel are connected by a connector instrument such that they are positioned spaced apart from each other by at least about 2 mm.

DETAILED DESCRIPTION OF THE INVENTION

The invention provides ballistic resistant articles for the formation of structural members of vehicles and other articles that require superior ballistic and impact resistance, in addition to high structural integrity. Particularly, the invention provides multi-panel, ballistic resistant articles wherein the panels are connected to each other such that they are positioned spaced apart from each other.

For the purposes of the invention, articles that have superior ballistic penetration resistance describe those which exhibit excellent properties against deformable projectiles. The articles also exhibit excellent resistance properties against fragment penetration, such as shrapnel.

Figure 1:
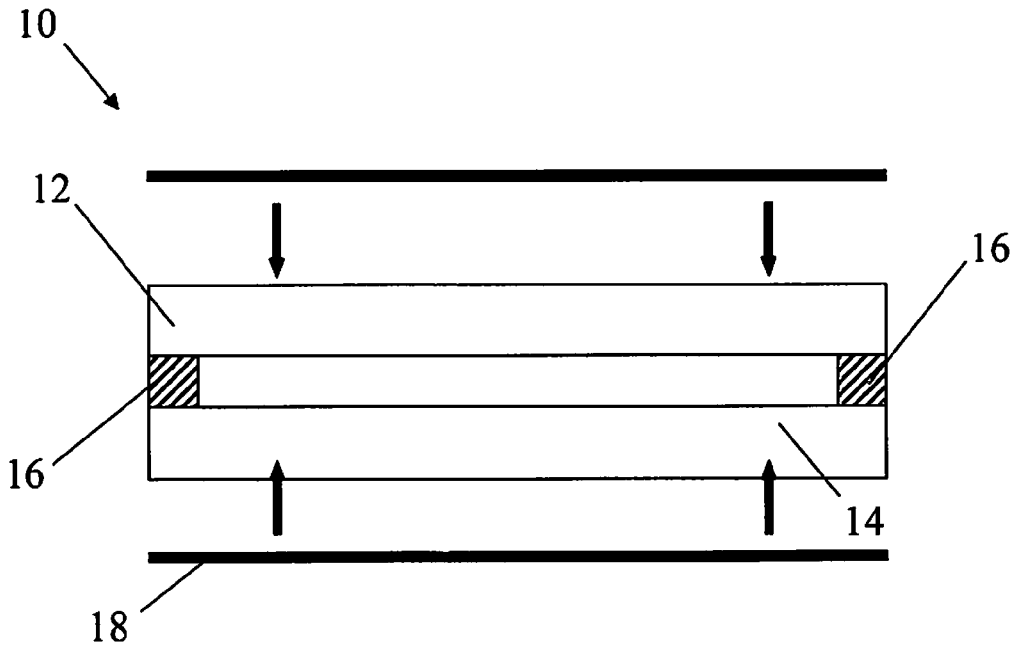
FIG. 1 is an edge view schematic representation of ballistic resistant article of the invention including two ballistic resistant panels connected by and spaced apart by connecting anchors.
Figure 2:
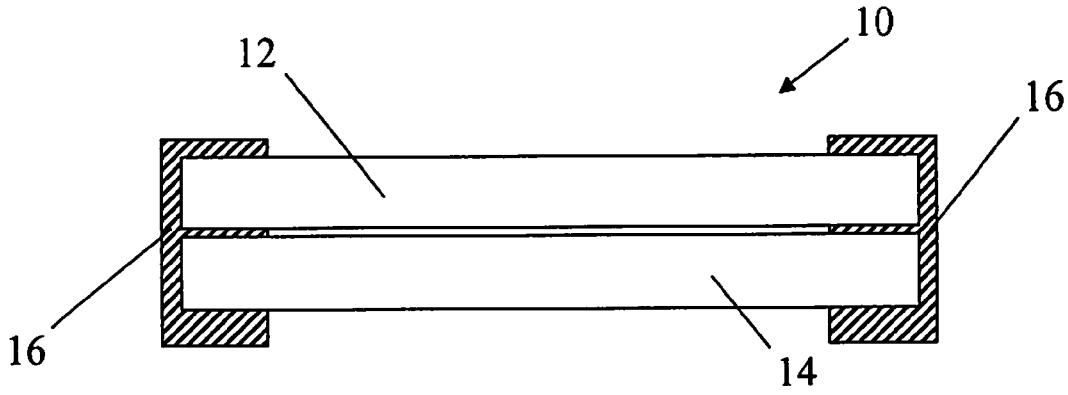
FIG. 2 is an edge view schematic representation of ballistic resistant article of the invention including two ballistic resistant panels connected by and spaced apart by a frame.

As illustrated in FIG. 1 and FIG. 2, the ballistic resistant articles include at least two individual panels 12 and 14, each panel comprising high strength fibers having a tenacity of about 7 g/denier or more and a tensile modulus of about 150 g/denier or more. Most broadly, a ballistic resistant article 10 of the invention comprises a first panel 12 attached to a second panel 14, each panel comprising one or more fibrous layers, each of the fibrous layers comprising a plurality of fibers, said fibers having a tenacity of about 7 g/denier or more and a tensile modulus of about 150 g/denier or more; each of said fibers having a surface, and the surfaces of said fibers optionally being coated with a polymeric composition. As seen in the figure, the panels are connected by a connector instrument 16, and are positioned spaced apart from each other by at least about 2 mm. The ballistic resistant articles of the invention may further include at least one additional panel connected to the second panel, wherein each additional panel may comprise woven fibers or non-woven fibers, or a combination thereof, and where wherein the first panel, second panel and each additional panel are connected by a connector instrument 16 such that each of the panels are positioned spaced apart from each other.

For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As used herein, a "yarn" is a strand of interlocked fibers. An "array" describes an orderly arrangement of fibers or yarns, and a "parallel array" describes an orderly parallel arrangement of fibers or yarns. A fiber "layer" describes a planar arrangement of woven or non-woven fibers or yarns. A fiber "network" denotes a plurality of interconnected fiber or yarn layers. A "consolidated network" describes a consolidated (merged) combination of fiber layers with a polymeric composition. As used herein, a "single layer" structure refers to monolithic structure composed of one or more individual fiber layers that have been consolidated into a single unitary structure. In general, a "fabric" may relate to either a woven or non-woven material.

The invention presents various embodiments that include two or more ballistic resistant panels, where each panel may comprise non-woven fibrous layers, woven fibrous layers, or a combination thereof. In the preferred embodiments of the invention, a panel of non-woven fibrous layers preferably comprises a single-layer, consolidated network of fibers and an elastomeric or rigid polymeric composition, which polymeric composition is also referred to in the art as a polymeric matrix composition. The terms "polymeric composition" and "polymeric matrix composition" are used interchangeably herein. More particularly, a single-layer, consolidated network of fibers comprises a plurality of fibrous layers (or "plies") stacked together, each fibrous layer (ply) comprising a plurality of fibers coated with the polymeric composition and unidirectionally aligned in an array so that they are substantially parallel to each other along a common fiber direction. As is conventionally known in the art, excellent ballistic resistance is achieved when individual fiber layer are cross-plied such that the fiber alignment direction of one layer is rotated at an angle with respect to the fiber alignment direction of another layer. Accordingly, successive layers of such unidirectionally aligned fibers are preferably rotated with respect to a previous layer. An example is a two layer (two ply) structure wherein adjacent layers (plies) are aligned in a 0°/90° orientation, where each individual non-woven ply is also known as a "unitape". However, adjacent layers can be aligned at virtually any angle between about 0° and about 90° with respect to the longitudinal fiber direction of another layer. For example, a five layer non-woven structure may have plies at a 0°/45°/90°/45°/0° orientation or at other angles. In the preferred embodiment of the invention, only two individual non-woven layers, cross plied at 0° and 90°, are consolidated into a single layer network, wherein one or more of said single layer networks make up a single non-woven panel. However, it should be understood that the single-layer consolidated networks of the invention may generally include any number of cross-plied (or non-cross-plied) plies. Most typically, the single-layer consolidated networks include from 1 to about 6 plies, but may include as many as about 10 to about 20 plies as may be desired for various applications. Such rotated unidirectional alignments are described, for example, in U.S. Pat. Nos. 4,457,985; 4,748,064; 4,916,000; 4,403,012; 4,623,573; and 4,737,402 Likewise, a "panel" is a monolithic structure that may include any number of component fiber layers, but typically includes 1 to about 5 fiber layers, and each panel may comprise a plurality of fibrous layers which comprise non-woven fibers, a plurality of fibrous layers which comprise woven fibers, or a combination of woven fibrous layers and non-woven fibrous layers. A ballistic resistant article of the invention may also comprise at least one panel which comprises a plurality of fibrous layers which comprise non-woven fibers and at least one panel which comprises a plurality of fibrous layers which comprise woven fibers.

The stacked fibrous layers are consolidated, or united into a monolithic structure by the application of heat and pressure, to form the single-layer, consolidated network, merging the fibers and the polymeric composition of each component fibrous layer. The non-woven fiber networks can be constructed using well known methods, such as by the methods described in U.S. Pat. No. 6,642,159. The consolidated network may also comprise a plurality of yarns that are coated with such a polymeric composition, formed into a plurality of layers and consolidated into a fabric. The non-woven fiber networks may also comprise a felted structure which is formed using conventionally known techniques, comprising fibers in a random orientation embedded in a suitable polymeric composition that are matted and compressed together.

For the purposes of the present invention, the term "coated" is not intended to limit the method by which the polymeric composition is applied onto the fiber surface or surfaces. The application of the polymeric composition is conducted prior to consolidating the fiber layers, and any appropriate method of applying the polymeric composition onto the fiber surfaces may be utilized. Accordingly, the fibers of the invention may be coated on, impregnated with, embedded in, or otherwise applied with a polymeric composition by applying the composition to the fibers and then optionally consolidating the composition-fibers combination to form a composite. As stated above, by "consolidating" it is meant that the polymeric composition material and each individual fiber layer are combined into a single unitary layer. Consolidation can occur via drying, cooling, heating, pressure or a combination thereof. The term "composite" refers to consolidated combinations of fibers with the polymeric matrix composition. The term "matrix" as used herein is well known in the art, and is used to represent a polymeric binder material that binds the fibers together after consolidation.

The woven fibrous layers of the invention are also formed using techniques that are well known in the art using any fabric weave, such as plain weave, crowfoot weave, basket weave, satin weave, twill weave and the like. Plain weave is most common. Prior to weaving, the individual fibers of each woven fibrous material may or may not be coated with a polymeric composition in a similar fashion as the non-woven fibrous layers using the same polymeric compositions as the non-woven fibrous layers.

In the preferred embodiments of the invention, the panels forming the ballistic resistant articles of the invention are connected to each other by one or more connector instruments 16 such that they are positioned spaced apart from each other by at least about 2 mm, preferably from about 2 mm to about 13 mm, and more preferably from about 6 mm to about 13 mm. The panels may alternately be spaced from each other by greater than 13 mm, but greater spacings are not as preferred and spacings too great may reduce the functionality of the articles. More than two panels may form an article of the invention, and when more than two panels are included each panel is connected to each adjacent panel by a connector instrument such that they are positioned spaced apart from each other by at least about 2 mm, preferably from about 2 mm to about 13 mm, and more preferably from about 6 mm to about 13 mm. It has been unexpectedly found that spacing ballistic resistant panels apart from each other reduces back-face deformation compared to a configuration where multiple panels are directly bonded together, while maintaining superior ballistic resistance properties.

As used herein, the term "connected" means that the panels are joined together by a connector instrument as integral elements of a single, unitary article, but the surfaces of the panels do not touch each other. As described herein, a "connector instrument" refers to any element or material that connects two or more panels of the invention such that they are positioned spaced apart from each other by at least about 2 mm, and which forms an integral component of the ballistic resistant articles of the invention. As a result, connected panels of the invention may be separated by only air, wherein an open space is present between adjacent panels. Alternately, a connector instrument 16 (or connector instruments 16) may be a material that fills the full space or a part of the space between adjacent panels, whereby the separating medium is then the material of the spacer. For example, adjacent panels may be separated by a non-fabric intermediate connector instrument formed from wood, fiberboard, particleboard, a ceramic material, a metal sheet or a plastic sheet. The intermediate connector instrument may alternately be a connecting foam, preferably a flexible, open-cell foam. These materials are positioned between and in contact with each of the panels forming the articles of the invention.

Figure 3:
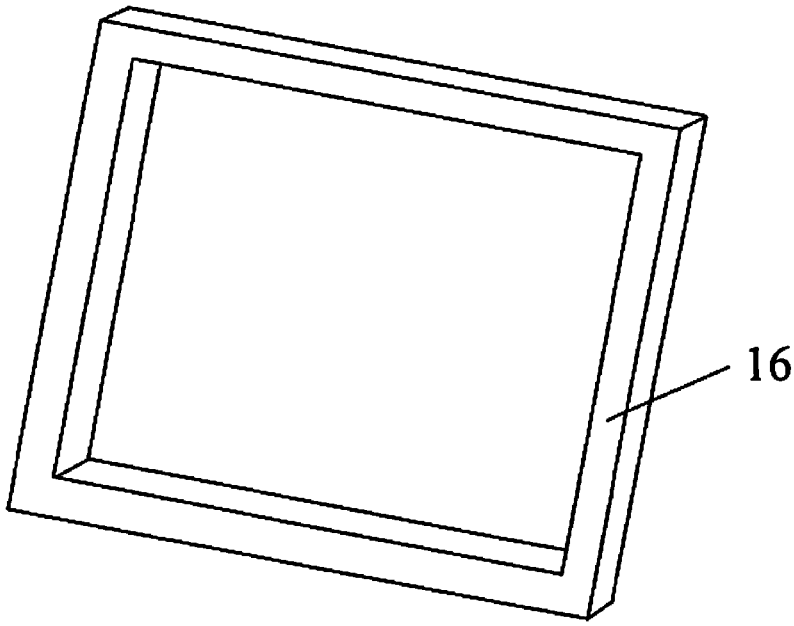
FIG. 3 is a perspective view schematic representation of a frame structure.
Figure 4:
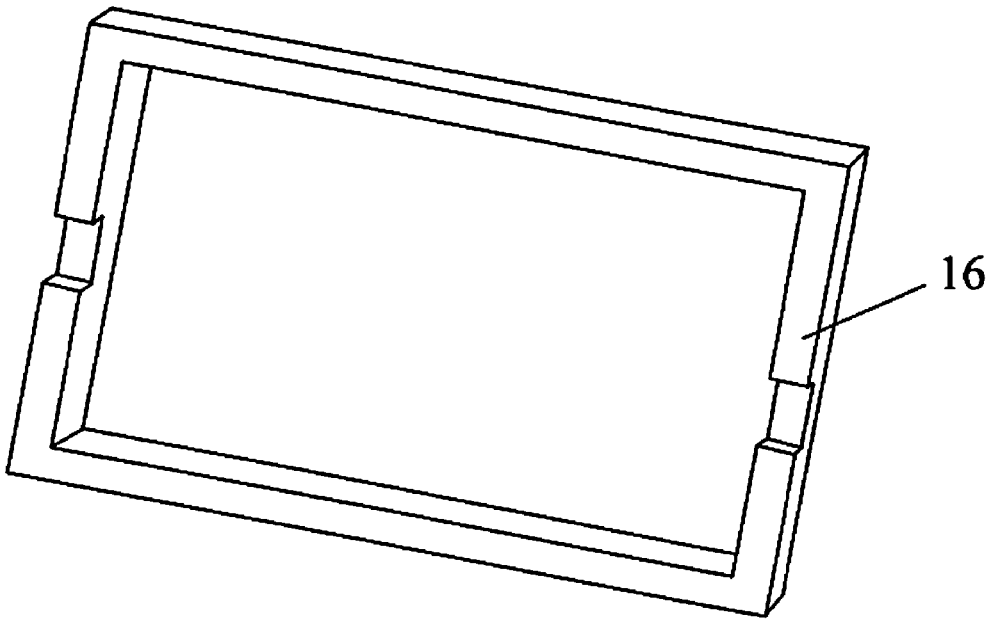
FIG. 4 is a perspective view schematic representation of a frame structure having carved out air vents.

Various instruments may be used to connect the multiple ballistic resistant panels of the invention. Non-limiting examples of connector instruments include connecting anchors, such as rivets, bolts, nails, screws and brads; flat spacing strips; spacing frames and extruded channels. Suitable spacing frames include slotted frames, where the panels of the invention would be positioned into slots (or grooves) of the frame which hold them in place; and non-slotted frames that are positioned between and attached to adjacent panels, thereby separating and connecting said panels. Frames may be formed from any suitable material as would be determined by one skilled in the art, including wood frames, metal frames and fiber reinforced polymer composite frames. Extruded channels may be formed of any extrudable material, including metals and polymers. Preferred connector instruments for connecting multiple panels in such a manner preferably are relatively rigid, non-fabric connectors formed of metal, ceramic, plastic, wood or other like material, where the connector is positioned between and attached to adjacent panels. FIG. 1 illustrates an embodiment where two ballistic resistant panels are spaced apart by connecting anchors 16 at the corners of the panels 12 and 14. FIG. 2 illustrates an embodiment where panels are separated by a slotted frame. FIGS. 3 and 4 are perspective view schematic representations of non-slotted frame structure. The frames may have any geometric shape, but are typically square or rectangular. The connector instruments of the invention are specifically exclusive of adhesives and fabric materials, such as other ballistic resistant fabrics, other non-ballistic resistant fabrics, or fiberglass. Wood materials are not considered fibrous materials and fiber reinforced polymer composites are not considered fabrics herein. Thus, an adhesive is not a connector instrument, and another fabric is not a connector instrument within the purposes of the invention.

Such connector strips or frame may be formed from any material, such as metal, wood, plastic, composites or any other suitable material. The dimensions of the connector strips or connecting, spacing frame may be tailored to the desired size of the panel, and should be designed to include a space between adjacent panels as specified above. For example, an aluminum frame having multiple slot channels can be used, wherein a first panel is slid into a first slot and a second panel is slid into a second slot that is spaced from the first slot by about ¼ inch (6.35 mm) or ½ inch (12.7 mm). In an article having more than two panels, the space between each set of two panels may be the same or different than another set of two panels. The panels may be attached to the spacing-connecting frame, strips or other structure using any variety of methods, including with an adhesive, by riveting, with nuts and bolts, by stitching, or with any other suitable means as would be determined by one skilled in the art. The connector instruments may or may not be in contact with the entire surface of a panel. For example, a connector may only be positioned along one or more edges of the interface between panels, or only at the corners of the interface.

Preferred connecting foams are flexible, open-cell foams positioned between the first panel and the second panel, and between any additional panels, which open-cell foam is in contact with each of said panels. Suitable open-cell foams non-exclusively include polyurethane foams, polyethylene foams, polyvinyl chloride (PVC) foams, and other thermoplastic resin foams. Polyurethane foams are the most common. Open-cell foams are commercially available and are described, for example, in U.S. Pat. Nos. 6,174,741, 6,093,752, 5,824,710, 5,114,773 and 4,957,798, the disclosures of which are incorporated herein by reference. Foams are also described in the publication *Handbook of Plastic Foams*, by Arthur H. Landrock, Noves Publication (1995). Foam raw material manufacturers include The Dow Chemical Company of Midland, Mich. and Bayer Corporation of Pittsburgh, Pa. Foam converters (from liquid to flexible foams) include American Excelsior Corp. of Texas, Foamtech Corporation of Massachusetts, Wisconsin Foam Products of Wisconsin, UFP Technologies of Massachusetts and Sealed Air Corporation of New Jersey. Rigid, closed-cell foams may also be used but are not preferred for the present invention because they include entrapped air which may behave as a rigid material during ballistic projectile impact, reducing ballistic performance of the articles of the invention. Foams are also known for adding sound proofing to articles.

Preferably, an intermediate foam is capable of adhering to each panel without the use of a separate adhesive material. In the preferred embodiment of the invention, the panels of the invention are connected by a connector instrument such that any air located between panels may easily escape upon impact by a projectile, without the air being compressed.

In a further embodiment of the invention, prior to attaching a panel to a connector instrument, it is preferred that each of the panels be reinforced. Edges may be melted, for example, using an edge mold or using a solid metal frame-like structure, e.g. a solid metal picture frame-like structure. The edge mold or solid metal frame can be heated using an oven or mounted in a press which has heating and cooling capability. The mold or metal frame will press and mold only the edges. Melting conditions, such as temperatures, pressures and duration, will be dependent on factors such as the number of fiber layers or panels and their thicknesses. Such conditions would be readily determined by one skilled in the art. Once the boundaries of a panel are reinforced, it is easier to work the panel with nuts and bolts, and easier to attach to connector instruments such as metal strips, composite connectors, or a spacing frame structure. Additionally, if possible depending on the type of connector used, the panels may be similarly attached to the connector by melting them together using similar techniques.

For optimal ballistic performance, in embodiments where a connector instrument might cause air to be entrapped between adjacent panels, it is further preferred that an air vent be present at the interface of the connector instrument and at least one of the panels, preferably at an edge between the attachment interface between a panel and the connector instrument to allow any entrapped air to escape when a projectile hits the front panel. For example, as illustrated in FIG. 4, a non-slotted spacing frame may be used where a portion of the frame is carved out, allowing the venting of air. The portion of the spacing frame may be carved out using any useful technique. To facilitate the carving out of the air vents, frames having said vents are preferably formed from wood, such as plywood, but may be formed from any material. For example, metal and metal channels may also require air venting. Without an air vent, the ballistic performance may be reduced because entrapped air may act as a rigid material and reduce the deformation of first panel, thereby reducing the ballistic performance of the panel. Other means of venting air may be used as well, as would be determined by one skilled in the art. In a preferred embodiment, a non-slotted spacing frame has edges ½" wide and ¼" deep, and preferably has air vents ⅛" in depth carved out of two opposite edges (see FIG. 4). This type of non-slotted frame would be positioned between two adjacent fabric panels, where the panels are attached to the frame by any means commonly known in the art, such as adhering.

Each panel of the invention comprises a combination of fibers and an optional matrix composition. In general, to produce a fabric article having sufficient ballistic resistance properties, the proportion of fibers in each panel preferably comprises from about 45% by weight to about 95% by weight of the fibers plus the optional polymeric matrix composition, more preferably from about 60% to about 90%, and most preferably from about 65% to about 85% by weight of the fibers plus the optional polymeric matrix composition. As is commonly known in the art, the matrix composition may also include other additives such as fillers, such as carbon black or silica, may be extended with oils, or may be vulcanized by sulfur, peroxide, metal oxide or radiation cure systems as is well known in the art. In a panel wherein the fibers forming the panel are not coated with a polymeric composition, the fibers comprise 100% by weight of the panel.

Further, each panel of woven or non-woven fibrous layers preferably comprises a plurality of component fibrous layers, where the greater the number of layers translates into greater ballistic resistance, but also greater weight. A non-woven fibrous panel, in particular, preferably comprises two or more layers that are consolidated into a monolithic panel. A woven fibrous panel may also comprise a plurality of consolidated woven fibrous layers, which are consolidated by molding under pressure. Preferred structures of the invention depend on the ballistic threat, e.g. deformable and non-deformable threat, energy associated with the threat, and desired panel spacing. The structure may be all woven molded panels, all non-woven panels, or a hybrid of woven and non-woven panels.

The number of layers forming a single panel, and the number of layers forming the non-woven composite vary depending upon the ultimate use of the desired ballistic resistant article. For example, in body armor vests for military applications, in order to form an article composite that achieves a desired 1.0 pound per square foot areal density (4.9 $kg/m^2$), a total of at 22 individual layers (or plies) may be required, wherein the plies may be woven, knitted, felted or non-woven fabrics formed from the high-strength fibers described herein, and the layers may or may not be attached together. In another embodiment, body armor vests for law enforcement use may have a number of layers based on the National Institute of Justice (NIJ) Threat Level. For example, for an NIJ Threat Level IIIA vest, there may also be a total of 22 layers. For a lower NIJ Threat Level, fewer layers may be employed.

The woven or non-woven fibrous layers of the invention may be prepared using a variety of polymeric composition (polymeric matrix composition) materials, including both low modulus, elastomeric materials and high modulus, rigid materials. Suitable polymeric composition materials non-exclusively include low modulus, elastomeric materials having an initial tensile modulus less than about 6,000 psi (41.3 MPa), and high modulus, rigid materials having an initial tensile modulus at least about 300,000 psi (2068 MPa), each as measured at 37° C. by ASTM D638. As used herein throughout, the term tensile modulus means the modulus of elasticity as measured by ASTM 2256 for a fiber and by ASTM D638 for a polymeric composition material.

An elastomeric polymeric composition may comprise a variety of polymeric and non-polymeric materials. The preferred elastomeric polymeric composition comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably less than about 0° C., more preferably the less than about −40° C., and most preferably less than about −50° C. The elastomer also has a preferred elongation to break of at least about 50%, more preferably at least about 100% and most preferably has an elongation to break of at least about 300%.

A wide variety of materials and formulations having a low modulus may be utilized as the polymeric composition. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, and combinations thereof, and other low modulus polymers and copolymers curable below the melting point of the polyolefin fiber. Also preferred are blends of different elastomeric materials, or blends of elastomeric materials with one or more thermoplastics. The polymeric composition may also include fillers such as carbon black or silica, may be extended with oils, or may be vulcanized by sulfur, peroxide, metal oxide or radiation cure systems as is well known in the art.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type R-$(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred polymeric composition polymer comprises styrenic block copolymers sold under the trademark KRATON® commercially produced by Kraton Polymers. The most preferred low modulus polymeric matrix composition comprises a polystyrene-polyisoprene-polystrene-block copolymer.

Preferred high modulus, rigid polymeric composition materials useful herein include materials such as a vinyl ester polymer or a styrene-butadiene block copolymer, and also mixtures of polymers such as vinyl ester and diallyl phthalate or phenol formaldehyde and polyvinyl butyral. A particularly preferred rigid polymeric composition material for use in this invention is a thermosetting polymer, preferably soluble in carbon-carbon saturated solvents such as methyl ethyl ketone, and possessing a high tensile modulus when cured of at least about $1\times10^6$ psi (6895 MPa) as measured by ASTM D638. Particularly preferred rigid polymeric composition materials are those described in U.S. Pat. No. 6,642,159, which is incorporated herein by reference.

In addition to the non-woven fibrous layers, the woven fibrous layers are also preferably coated with the polymeric composition. Preferably the fibers comprising the woven fibrous layers are at least partially coated with a polymeric composition, followed by a consolidation step similar to that conducted with non-woven fibrous layers. However, coating the woven fibrous layers with a polymeric composition is not required. For example, a plurality of woven fibrous layers forming a panel of the invention do not necessarily have to be consolidated, and may be attached by other means, such as with a conventional adhesive, or by stitching. Generally, a polymeric composition coating is necessary to efficiently merge, i.e. consolidate, a plurality of fibrous layers. In the preferred embodiment of the invention, a matrix-free panel, if included, preferably comprises one or more woven fibrous layers that are not coated with a polymeric composition, wherein multiple woven layers may be joined by stitching or any other common method.

The rigidity, impact and ballistic properties of the articles formed from the fabric composites of the invention are affected by the tensile modulus of the polymeric composition polymer. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without a polymeric matrix composition. However, low tensile modulus polymeric matrix composition polymers also yield lower rigidity composites. Further, in certain applications, particularly those where a composite must function in both anti-ballistic and structural modes, there is needed a superior combination of ballistic resistance and rigidity. Accordingly, the most appropriate type of polymeric composition polymer to be used will vary depending on the type of article to be formed from the fabrics of the invention. In order to achieve a compromise in both properties, a suitable polymeric composition may combine both low modulus and high modulus materials to form a single polymeric composition.

The remaining portion of the composite is preferably composed of fibers. In accordance with the invention, the fibers comprising each of the woven and non-woven fibrous layers preferably comprise high-strength, high tensile modulus fibers. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

Particularly suitable high-strength, high tensile modulus fiber materials include polyolefin fibers, particularly extended chain polyolefin fibers, such as highly oriented, high molecular weight polyethylene fibers, particularly ultra-high molecular weight polyethylene fibers and ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, and liquid crystal copolyester fibers. Each of these fiber types is conventionally known in the art.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,623,547 and 4,748,064.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by DuPont corporation under the trademark of KEVLAR®. Also useful in the practice of this invention are poly(m-phenylene isophthalamide) fibers produced commercially by DuPont under the trademark NOMEX®, fibers produced commercially by Teijin under the trademark TWARON®; aramid fibers produced commercially by Kolon Industries, Inc. of Korea under the trademark Heracron®; p-aramid fibers SVM™ and Rusar™which are produced commercially by Kamensk Volokno JSC of Russia and Armos™ p-aramid fibers produced commercially by JSC Chim Volokno of Russia.

Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Preferred polybenzazole fibers are ZYLON® brand fibers from Toyobo Co. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

Suitable polypropylene fibers include highly oriented extended chain polypropylene (ECPP) fibers as described in U.S. Pat. No. 4,413,110, which is incorporated herein by reference. Suitable polyvinyl alcohol (PV—OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and are widely commercially available.

The other suitable fiber types for use in the present invention include glass fibers, fibers formed from carbon, fibers formed from basalt or other minerals, rigid rod fibers such as M5® fibers, and combinations of all the above materials, all of which are commercially available. For example, the fibrous layers may be formed from a combination of SPECTRA® fibers and Kevlar® fibers. M5® fibers are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene SPECTRA® fibers, and aramid Kevlar® fibers. The fibers may be of any suitable denier, such as, for example, 50 to about 3000 denier, more preferably from about 200 to 3000 denier, most preferably from about 650 to about 1500 denier.

The most preferred fibers for the purposes of the invention are either high-strength, high tensile modulus extended chain polyethylene fibers or high-strength, high tensile modulus para-aramid fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more.

These combined high strength properties are obtainable by employing well known processes. U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. Such methods, including solution grown or gel fiber processes, are well known in the art. Methods of forming each of the other preferred fiber types, including para-aramid fibers, are also conventionally known in the art, and the fibers are commercially available.

As discussed above, the polymeric composition (matrix) may be applied to a fiber in a variety of ways, and the term "coated" is not intended to limit the method by which the polymeric composition is applied onto the fiber surface or surfaces. For example, the polymeric composition may be applied in solution form by spraying or roll coating a solution of the polymeric composition onto fiber surfaces, wherein a portion of the solution comprises the desired polymer or polymers and a portion of the solution comprises a solvent capable of dissolving the polymer or polymers, followed by drying. Another method is to apply a neat polymer of the coating material to fibers either as a liquid, a sticky solid or particles in suspension or as a fluidized bed. Alternatively, the coating may be applied as a solution or emulsion in a suitable solvent which does not adversely affect the properties of the fiber at the temperature of application. For example, the fiber can be transported through a solution of the polymeric composition to substantially coat the fiber and then dried to form a coated fiber. The resulting coated fiber can then be arranged into the desired network configuration. In another coating technique, a layer of fibers may first be arranged, followed by dipping the layer into a bath of a solution containing the polymeric composition dissolved in a suitable solvent, such that each individual fiber is substantially coated with the polymeric composition, and then dried through evaporation or volatilization of the solvent. The dipping procedure may be repeated several times as required to place a desired amount of polymeric composition coating on the fibers, preferably encapsulating each of the individual fibers or covering 100% of the fiber surface area with the polymeric composition.

While any liquid capable of dissolving or dispersing a polymer may be used, preferred groups of solvents include water, paraffin oils and aromatic solvents or hydrocarbon solvents, with illustrative specific solvents including paraffin oil, xylene, toluene, octane, cyclohexane, methyl ethyl ketone (MEK) and acetone. The techniques used to dissolve or disperse the coating polymers in the solvents will be those conventionally used for the coating of similar materials on a variety of substrates.

Other techniques for applying the coating to the fibers may be used, including coating of the high modulus precursor (gel fiber) before the fibers are subjected to a high temperature stretching operation, either before or after removal of the solvent from the fiber (if using the gel-spinning fiber forming technique). The fiber may then be stretched at elevated temperatures to produce the coated fibers. The gel fiber may be passed through a solution of the appropriate coating polymer under conditions to attain the desired coating. Crystallization of the high molecular weight polymer in the gel fiber may or may not have taken place before the fiber passes into the solution. Alternatively, the fiber may be extruded into a fluidized bed of an appropriate polymeric powder. Furthermore, if a stretching operation or other manipulative process, e.g. solvent exchanging, drying or the like is conducted, the coating may be applied to a precursor material of the final fiber. In the most preferred embodiment of the invention, the fibers of the invention are first coated with the polymeric composition, followed by arranging a plurality of fibers into either a woven or non-woven fiber layer. Such techniques are well known in the art.

In another preferred embodiment of the invention, at least one polymer film may be attached to one or more of the outer surfaces of any of the panels of the invention. A polymer film may be desired to decrease friction between panels, because some panel types have sticky surfaces. Suitable polymers for said polymer film non-exclusively include thermoplastic and thermosetting polymers. Suitable thermoplastic polymers non-exclusively may be selected from the group consisting of polyolefins, polyamides, polyesters, polyurethanes, vinyl polymers, fluoropolymers and co-polymers and mixtures thereof. Of these, polyolefin layers are preferred. The preferred polyolefin is a polyethylene. Non-limiting examples of polyethylene films are low density polyethylene (LDPE), linear low density polyethylene (LLDPE), linear medium density polyethylene (LMDPE), linear very-low density polyethylene (VLDPE), linear ultra-low density polyethylene (ULDPE), high density polyethylene (HDPE). Of these, the most preferred polyethylene is LLDPE. Suitable thermosetting polymers non-exclusively include thermoset allyls, aminos, cyanates, epoxies, phenolics, unsaturated polyesters, bismaleimides, rigid polyurethanes, silicones, vinyl esters and their copolymers and blends, such as those described in U.S. Pat. Nos. 6,846,758, 6,841,492 and 6,642,159. As described herein, a polymer film includes polymer coatings.

Such optional polymer films may be attached to one or both of the outer surfaces of a panel using well known lamination techniques. Typically, laminating is done by positioning the individual layers on one another under conditions of sufficient heat and pressure to cause the layers to combine into a unitary film. The individual layers are positioned on one another, and the combination is then typically passed through the nip of a pair of heated laminating rollers by techniques well known in the art. Lamination heating may be done at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. Alternately, a polymeric film may be attached to a panel during a molding step described below. In the preferred embodiment of the invention, optional polymer film layers would comprise from about 2% to about 25% by weight based on the combined weight of the fibers, polymeric matrix composition and polymer films, more preferably from about 2% to about 17% percent by weight and most preferably from 2% to 12% by weight. The percent by weight of the polymer film layers will generally vary depending on the number of fabric layers forming a panel.

In forming the panels of the invention, multiple fibrous layers are preferably molded under heat and pressure in a suitable molding apparatus. Generally, the panels are molded at a pressure of from about 50 psi (344.7 kPa) to about 5000 psi (34470 kPa), more preferably about 100 psi (689.5 kPa) to about 1500 psi (10340 kPa), most preferably from about 150 psi (1034 kPa) to about 1000 psi (6895 kPa). The fibrous layers may alternately be molded at higher pressures of from about 500 psi (3447 kPa) to about 5000 psi, more preferably from about 750 psi (5171 kPa) to about 5000 psi and more preferably from about 1000 psi to about 5000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. (~149° C.) and most preferably at a temperature from about 200° F. to about 280° F. (~121° C.). Suitable molding temperatures, pressures and times will generally vary depending on the type of polymeric composition type, polymeric composition content, and type of fiber. The pressure under which the fabrics of the invention are molded has a direct effect on the stiffness or flexibility of the resulting molded product. Particularly, the higher the pressure at which the fabrics are molded, the higher the stiffness, and vice-versa. In addition to the molding pressure, the quantity, thickness and composition of the fabric layers, polymeric composition type and optional polymer film also directly affects the stiffness of the articles formed from the inventive fabrics.

While each of the molding and consolidation techniques described herein may appear similar, each process is different. Particularly, molding is a batch process and consolidation is a continuous process. Further, molding typically involves the use of a mold, such as a shaped mold or a match-die mold when forming a flat panel.

If a separate consolidation step is conducted to form one or more single layer, consolidated networks prior to molding, the consolidation may be conducted in an autoclave, as is conventionally known in the art. When heating, it is possible that the polymeric composition can be caused to stick or flow without completely melting. However, generally, if the polymeric composition material is caused to melt, relatively little pressure is required to form the composite, while if the polymeric composition material is only heated to a sticking point, more pressure is typically required. The consolidation step may generally take from about 10 seconds to about 24 hours. Similar to molding, suitable consolidation temperatures, pressures and times are generally dependent on the type of polymer, polymer content, process used and type of fiber.

The panels or fabrics of the invention may optionally be calendared under heat and pressure to smooth or polish their surfaces. Calendaring methods are well known in the art and may be conducted prior to or after molding.

The thickness of the individual fabric layers and panels will correspond to the thickness of the individual fibers. Accordingly, a preferred woven fibrous layer will have a preferred thickness of from about 25 μm to about 500 μm, more preferably from about 75 μm to about 385 μm and most preferably from about 125 μm to about 255 μm. A preferred single-layer, consolidated network will have a preferred thickness of from about 12 μm to about 500 μm, more preferably from about 75 μm to about 385 μm and most preferably from about 125 μm to about 255 μm. A polymer film is preferably very thin, having preferred thicknesses of from about 1 μm to about 250 μm, more preferably from about 5 μm to about 25 μm and most preferably from about 5 μm to about 9 μm. A ballistic resistant article, including a series of interconnected ballistic resistant panels and any optional polymer films, has a preferred total thickness of about 5 μm to about 1000 μm, more preferably from about 6 μm to about 750 μm and most preferably from about 7 μm to about 500 μm. While such thicknesses are preferred, it is to be understood that other film thicknesses may be produced to satisfy a particular need and yet fall within the scope of the present invention. The multi-panel articles of the invention further have a preferred areal density of from about 0.25 lb/ft2 (psf) (1.22 kg/m2 (ksm)) to about 8.0 psf (39.04 ksm), more preferably from about 0.5 psf (2.44 ksm) to about 6.0 psf (29.29 ksm), more preferably from about 0.7 psf (3.41 ksm) to about 5.0 psf (24.41), and most preferably from about 0.75 psf to about 4.0 psf (19.53 ksm).

In another embodiment, at least one rigid plate 18 may be attached to a ballistic resistant article of the invention to increase protection against armor piercing projectiles. In ballistic resistant vest and vehicle armor applications, articles including a rigid plate 18 are commonly desirable. Such a rigid plate 18 may comprise a ceramic, a glass, a metal-filled composite, a ceramic-filled composite, a glass-filled composite, a cermet, high hardness steel (HHS), armor aluminum alloy, titanium or a combination thereof, wherein the rigid plate and the inventive panels are stacked together in face-to-face relationship. Preferably only one rigid plate 18 is attached to the top surface of a series of panels, rather than to each individual panel of a series. The three most preferred types of ceramics include aluminum oxide, silicon carbide and boron carbide.

The ballistic panels of the invention may incorporate a single monolithic ceramic plate, or may comprise small tiles or ceramic balls suspended in flexible resin, such as a polyurethane. Suitable resins are well known in the art. Additionally, multiple layers or rows of tiles may be attached to the plates of the invention. For example, multiple 3"×3"×0.1" (7.62 cm×7.62 cm×0.254 cm) ceramic tiles may be mounted on a 12"×12" (30.48 cm×30.48 cm) panel using a thin polyurethane adhesive film, preferably with all ceramic tiles being lined up with such that no gap is present between tiles. A second row of tiles may then be attached to the first row of ceramic, with an offset so that joints are scattered. This continues all the way down to cover the entire armor. For high performance at the lowest weight, it is preferred that panels are molded before attaching a rigid plate. However, for large panels, e.g. 4'×6' (1.219 m×1.829 m) or 4'×8' (1.219 m×2.438 m), a panel may be molded in a single, low pressure autoclave process together with a rigid plate.

The multi-panel structures of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758.

The multi-panel structures are useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devices encountered in a military and peace keeping missions. The multi-panel structures of the invention are particularly useful for reinforcing objects such as structural members of airplanes and members of other vehicles, including doors and bulk head structures of automobiles and marine vessels, where the structures of the invention are attached to or placed inside the structural members. The structures are also useful for protecting large building structures from explosions, and for reinforcing movable ballistic walls, bunkers and other similar structures.

As used herein, "soft" or "flexible" armor is armor that does not retain its shape when subjected to a significant amount of stress and is incapable of being free-standing without collapsing. The multi-panel structures are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. The structures can be cut into a plurality of discrete sheets and stacked for formation into an article or they can be formed into a precursor which is subsequently used to form an article. Such techniques are well known in the art.

Garments of the invention may be formed through methods conventionally known in the art. Preferably, a garment may be formed by adjoining the ballistic resistant articles of the invention with an article of clothing. For example, a vest may comprise a generic fabric vest that is adjoined with the ballistic resistant structures of the invention, whereby the inventive articles are inserted into strategically placed pockets. For best results, the panels having the greatest quantity of the polymeric composition should be positioned closest to a potential ballistic threat, and the panels having the least amount of polymeric composition should be positioned furthest from a potential ballistic threat. This allows for the maximization of ballistic protection, while minimizing the weight of the vest. As used herein, the terms "adjoining" or "adjoined" are intended to include attaching, such as by sewing or adhering and the like, as well as un-attached coupling or juxtaposition with another fabric, such that the ballistic resistant articles may optionally be easily removable from the vest or other article of clothing. Articles used in forming flexible structures like flexible sheets, vests and other garments are preferably formed from using a low tensile modulus polymeric matrix composition. Hard articles like helmets and armor are preferably formed using a high tensile modulus polymeric matrix composition.

The ballistic resistance properties are determined using standard testing procedures that are well known in the art. Particularly, the protective power or penetration resistance of a structure is normally expressed by citing the impacting velocity at which 50% of the projectiles penetrate the composite while 50% are stopped by the shield, also known as the $V_{50}$ value. As used herein, the "penetration resistance" of an article is the resistance to penetration by a designated threat, such as physical objects including bullets, fragments, shrapnel and the like, and non-physical objects, such as a blast from explosion. For composites of equal areal density, which is the weight of the composite panel divided by the surface area, the higher the $V_{50}$, the better the resistance of the composite. The ballistic resistant properties of the articles of the invention will vary depending on many factors, particularly the type of fibers used to manufacture the fabrics.

Flexible ballistic armor formed herein preferably have a $V_{50}$ of at least about 1400 feet/second (fps) (427 msec) when impacted with a 17 grain fragment simulated projectile (fsp).

The following non-limiting examples serve to illustrate the invention.

EXAMPLES 1-8

Ballistic test packages having varying configurations were assembled from a plurality of layers of Spectra Shield® II SR 3124 ballistic composite material, where one layer includes four plies (i.e. four unitapes) of non-woven consolidated material (adjacent plies cross-plied at 0°, 90°) made with SPECTRA® 1000 fibers (1300 denier) and a water-based KRATON® resin, the resin comprising about 16% of the 4-ply layer. The assembled test packages were tested against 17 grain fragment simulating projectiles (FSP) (MIL-P-46593A (ORD)) according to military testing standard MIL-STD-662E to determine the $V_{50}$ of the molded panels. The test packages were formed from one or more 12"×12" molded panels of the Spectra Shield® II SR 3124 material, and had the configurations described below and outlined in Table 1 (panel molding conditions: 240° F. (115.6° C.), 10 minutes pre-heat, 10 minutes under 500 psi, no cool down). The average total areal density of each panel of the test package was 1.04 psf (5.08 ksm).

Example 1 (comparative) tested a test package including a single molded panel, which single molded panel included twenty 4-ply layers of Spectra Shield® II SR 3124 (i.e. 80 unitapes in the panel, adjacent unitapes cross-plied at 0°/90°), as a control sample. Each 4-ply layer was consolidated first, followed by molding the twenty layers together under the above-stated conditions to form the panel.

Example 2 (comparative) tested a test package including twenty individually molded panels, each panel including one 4-ply layer of Spectra Shield® II SR 3124 (i.e. four unitapes per panel, adjacent unitapes cross-plied at 0°/90°), the unitapes being molded together under the above-stated conditions to form each panel. The panels were held together in the testing apparatus by c-clamps with their surfaces in contact with each other and were not interconnected by stitching, adhesives or any other means. The panels were not spaced apart.

Example 3 (comparative) tested a test package including four individually molded panels, each panel including five 4-ply layers of Spectra Shield® II SR 3124 (i.e. 20 unitapes per panel, adjacent unitapes cross-plied at 0°/90°). The 4-ply layers were consolidated first, then five of them were molded together under the above-stated conditions to form each panel. The panels were held together in the testing apparatus by clamps with their surfaces in contact with each other but were not interconnected. The panels were not spaced apart.

Example 4 (comparative) tested a test package including two individually molded panels, each panel including ten 4-ply layers of Spectra Shield® II SR 3124 (i.e. 40 unitapes per panel, adjacent unitapes cross-plied at 0°/90°). The 4-ply layers were consolidated first, then ten of them were molded together under the above-stated conditions to form each panel. The panels were held together in the testing apparatus by clamps with their surfaces in contact with each other but were not interconnected. The panels were not spaced apart.

Example 5 tested a test package similar to Example 3, including four individually molded panels, each panel including five 4-ply layers of Spectra Shield® II SR 3124. However, the panels were spaced apart and interconnected by inserting them into a slotted wood frame such that they were positioned spaced apart from each other by ¼".

Example 6 tested a test package similar to Example 4, including two individually molded panels, each panel including ten 4-ply layers of Spectra Shield® II SR 3124. However, the panels were spaced apart and interconnected by inserting them into a slotted wood frame such that they were positioned spaced apart from each other by ¼".

Example 7 tested a test package similar to Example 6, however the panels were spaced apart and interconnected by an intermediate medium that consisted of a flexible, open-cell foam (density: 4.4 lbs/ft$^3$ (0.07 g/cm$^3$)) such that the panels were positioned spaced apart from each other by ½".

Example 8 tested a test package similar to Example 6, however the panels were spaced apart and interconnected by an intermediate medium that consisted of ¼" plywood such that they were positioned spaced apart from each other by ¼". The panels were attached to the plywood with a spray adhesive (Hi-Strength 90 adhesive, commercially available from 3M® of St. Paul, Minn.).

TABLE 1

| Example | Configuration | Unitapes In Each Panel | Spacing Distance | Spacing Medium | Total Test Package Thickness (inch) | $V_{50}$, 17 grain FSP (ft/sec) |
|---|---|---|---|---|---|---|
| 1 (Comp) | Control, Single Panel | 80 | N/A | N/A | 0.219 (5.5 mm) | 1978 (603 m/s) |
| 2 (Comp) | 20 Molded Single Layers, (20 panels) | 4 | N/A | None | 0.218 (5.5 mm) | 2015 (614 m/s) |
| 3 (Comp) | 4 Molded Panels | 20 | N/A | None | 0.223 (5.7 mm) | 1995 (608 m/s) |
| 4 (Comp) | 2 Molded Panels | 40 | N/A | None | 0.220 (5.6 mm) | 2016 (615 m/s) |
| 5 | 4 Molded Panels | 20 | 1/4" | Air | 0.925 (23.5 mm) | 1893 (577 m/s) |
| 6 | 2 Molded Panels | 40 | 1/4" | Air | 0.412 (10.5 mm) | 1950 (594 m/s) |
| 7 | 2 Molded Panels | 40 | 1/2" | Flexible, Open-Cell Foam | 0.720 (18.3 mm) | 1935 (590 m/s) |
| 8 | 2 Molded Panels | 40 | 1/4" | Plywood | 0.415 (10.5 mm) | 2110 (643 m/s) |

From the above testing, it was observed that ballistic performance of spaced molded panels against a 17 grain FSP, in various layer counts, was maintained. Performance against 17 grain FSP increased when "rigid" plywood is inserted between molded panels. The plywood had a certain ballistic resistance, but could not be quantified.

Examples 9-14

Ballistic test packages having varying configurations were assembled from Spectra Shield® II SR 3124 ballistic composite material. The panels were tested for $V_{50}$ against 9 mm full metal jacket (FMJ) bullets according to military testing standard MIL-STD-662E. The test packages were formed from one or more 21"×21" molded panels of the Spectra Shield® II SR 3124 material, and had the configurations described below and outlined in Table 2 (panel molding conditions: 240° F. (115.6° C.), 10 minutes pre-heat, 10 minutes under 500 psi, no cool down). The average total areal density of each of the molded panels was 1.04 psf (5.01 ksm).

Comparative Examples 9-12 utilized the same test package configurations as for Comparative Examples 1-4, respectively. Examples 13 and 14 utilized the same test package configurations as for Examples 5 and 6, respectively.

TABLE 2

| Example | Configuration | Unitapes In Each Panel | Spacing Distance | Spacing Medium | Total Thickness (inch) | $V_{50}$, 9 MM FMJ (ft/sec) |
|---|---|---|---|---|---|---|
| 9 (Comp) | Control, Single Panel | 80 | N/A | N/A | 0.216 (5.5 mm) | 2177 (664 m/s) |
| 10 (Comp) | 20 Molded Single Layers (20 Panels) | 4 | N/A | None | 0.217 (5.5 mm) | 1940 (591 m/s) |
| 11 (Comp) | 4 Molded Panels | 20 | N/A | None | 0.217 (5.5 mm) | 2140 (652 m/s) |
| 12 (Comp) | 2 Molded Panels | 40 | N/A | None | 0.215 (5.5 mm) | 2158 (658 m/s) |
| 13 | 4 Molded Panels | 20 | 1/4" | Air | 0.925 (23.5 mm) | 1886 (575 m/s) |
| 14 | 2 Molded Panels | 40 | 1/4" | Air | 0.412 (10.5 mm) | 2118 (646 m/s) |

From the above testing, it was observed that the ballistic performance of spaced molded panels against a 9 MM FMJ ballistic threat is maintained when the molded panels are not very thin.

Examples 15-19

Ballistic test packages having varying configurations were assembled from a plurality of layers of Spectra Shield® II SR 3124 ballistic composite material. The assembled test packages were tested against a high power rifle US military M80 ball bullet (weight: 9.65 g) according to military testing standard MIL-STD-662E to determine the $V_{50}$ of the molded panels. The test packages were formed from one or more 21"×21" molded panels of the Spectra Shield® II SR 3124 material, and had the configurations described below and outlined in Table 3 (panel molding conditions: 240° F. (115.6° C.), 10 minutes pre-heat, 10 minutes under 500 psi, no cool down; with the exception of the panels made in example 15 which were preheated for 25 minutes due to the increased thickness).

Example 15 (comparative) tested a test package including a single molded panel, which single molded panel included sixty-eight 4-ply layers (i.e. 272 unitapes in the panel; adjacent unitapes cross-plied at 0°/90°) as a control sample. The 4-ply layers were consolidated first, then 68 of them were molded together under the above-stated conditions to form the panel. The panels had a total areal weight of 3.52 psf (17.17 ksm).

Example 16 (comparative) tested a test package including four individually molded panels, each panel including seventeen 4-ply layers of Spectra Shield® II SR 3124 (i.e. 68 unitapes per panel, adjacent unitapes cross-plied at 0°/90°). The 4-ply layers were consolidated first, then 17 of them were molded together under the above-stated conditions to form each panel. The panels had a total areal weight of 3.51 psf (17.13 ksm). The panels were held together in the testing apparatus by clamps with their surfaces in contact with each other but were not interconnected. The panels were not spaced apart.

Example 17 (comparative) tested a test package including two individually molded panels, each panel including thirty-four 4-ply layers of Spectra Shield® II SR 3124 (i.e. 136 unitapes per panel, adjacent unitapes cross-plied at 0°/90°). The 4-ply layers were consolidated first, then 34 of them were molded together under the above-stated conditions to form each panel. The panels had a total areal weight of 3.53 psf (17.22 ksm). The panels were held together in the testing apparatus by clamps with their surfaces in contact with each other but were not interconnected. The panels were not spaced apart.

Example 18 tested a test package similar to Example 16, including four individually molded panels, each panel including seventeen 4-ply layers of Spectra Shield® II SR 3124. However, the panels were spaced apart and interconnected by inserting them into a slotted wood frame such that they were positioned spaced apart from each other by ¼". The panels had a total areal weight of 3.46 psf (16.88 ksm).

Example 19 tested a test package similar to Example 17, including two individually molded panels, each panel including thirty-four 4-ply layers of Spectra Shield® II SR 3124. However, the panels were spaced apart and interconnected by inserting them into a slotted wood frame such that they were positioned spaced apart from each other by ¼". The panels had a total areal weight of 3.52 psf (17.17 ksm).

TABLE 3

| Example | Configuration | Unitapes In Each panel | Spacing Distance | Spacing Medium | Total Thickness (Inch) | $V_{50}$, M80 ball (ft/sec) |
|---|---|---|---|---|---|---|
| 15 (Comp) | Control, Single Panel | 272 | N/A | N/A | 0.731 (18.6 mm) | 2815 (858 m/s) |
| 16 (Comp) | 4 Molded Panels | 68 | N/A | None | 0.719 (18.3 mm) | 2884 (879 m/s) |
| 17 (Comp) | 2 Molded Panels | 136 | N/A | None | 0.724 (18.4 mm) | 2830 (863 m/s) |
| 18 | 4 Molded Panels | 68 | 1/4" | Air | 0.987 (25.1 mm) | 2648 (807 m/s) |
| 19 | 2 Molded Panels | 136 | 1/4" | Air | 0.972 (24.7 mm) | 2849 (869 m/s) |

From the above testing, it was observed that the ballistic performance of panels touching each other has a higher ballistic resistance compared to a single molded panel of equivalent weight. The ballistic performance of two panels with ¼" air gap increased where the first panel deformed and destabilized the bullet. The performance of four relatively thinner panels kept ¼" apart showed that the bullet was not deformed or destabilized as effectively as a monolithic panel.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant article comprising:

a) a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and b) a second panel connected to the first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and c) wherein the first panel and the second panel are adjacent to each other and are connected by a connector instrument such that they are positioned spaced apart from each other by at least about 2 mm, wherein each panel is connected to each adjacent panel by a connector instrument such that they are positioned spaced apart from each other by at least about 2 mm, and wherein a space is present between adjacent connected panels such that the panels are separated by air.

2. The ballistic resistant article of claim 1 wherein the first panel and the second panel are spaced apart from each other by about 6 mm to about 13 mm, and wherein each panel is connected to each adjacent panel by a connector instrument such that they are positioned spaced apart from each other by about 6 mm to about 13 mm.

3. The ballistic resistant article of claim 1 wherein said connector instrument is non-fabric and is positioned between and in contact with each of the adjacent panels, and wherein said connector instrument comprises at least one connecting anchor, or one or more spacing strips, or one or more extruded channels, or a frame, wherein each of the at least one connecting anchor, one or more spacing strips, one or more extruded channels or the frame both connect and space apart adjacent panels leaving a space between adjacent connected panels.

4. The ballistic resistant article of claim 1 wherein said connector instrument comprises one or more spacing strips, one or more extruded channels, or a frame.

5. The ballistic resistant article of claim 1 further comprising an air vent at the interface of the connector instrument and at least one panel.

6. The ballistic resistant article of claim 1 further comprising at least one additional panel connected to said second panel, wherein the first panel, second panel and the at least one additional panel are connected such that each of the panels are positioned spaced apart from each other by at least about 2 mm, and wherein a space is present between each of the adjacent connected panels such that the panels are separated by air.

7. The ballistic resistant article of claim 1 comprising at least one panel which comprises a plurality of fibrous layers which comprise non-woven fibers.

8. The ballistic resistant article of claim 1 comprising at least one panel which comprises a plurality of fibrous layers which comprise woven fibers.

9. The ballistic resistant article of claim 1 wherein each panel independently comprises one or more polyolefin fibers, aramid fibers, polybenzazole fibers, polyvinyl alcohol fibers, polyamide fibers, polyethylene terephthalate fibers, polyethylene naphthalate fibers, polyacrylonitrile fibers, liquid crystal copolyester fibers, glass fibers, carbon fibers, rigid rod fibers, or a combination thereof.

10. The ballistic resistant article of claim 1 wherein each panel comprises polyethylene fibers.

11. The ballistic resistant article of claim 1 wherein the edges or boundaries of at least one panel are reinforced.

12. A method of forming a ballistic resistant article which comprises:

a) providing a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition;

b) connecting a second panel to said first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition, and wherein the first panel and the second panel are adjacent to each other and are connected by a connector instrument such that they are positioned spaced apart from each other by at least about 2 mm, wherein each panel is connected to each adjacent panel by a connector instrument such that they are positioned spaced apart from each other by at least about 2 mm, and wherein a space is present between adjacent connected panels such that the panels are separated by air.

13. The method of claim 12 wherein the first panel and the second panel are spaced apart from each other by about 6 mm to about 13 mm, and wherein each panel is connected to each adjacent panel by a connector instrument such that they are positioned spaced apart from each other by about 6 mm to about 13 mm.

14. The method of claim 12 wherein said connector instrument is non-fabric and is positioned between and in contact with each of the adjacent panels, and wherein said connector instrument comprises at least one connecting anchor, or one or more spacing strips, or one or more extruded channels, or a frame, wherein each of the at least one connecting anchor, one or more spacing strips, one or more extruded channels or the frame both connect and space apart adjacent panels leaving a space between adjacent connected panels.

15. The method of claim 12 wherein said connector instrument comprises one or more spacing strips, one or more extruded channels, or a frame.

16. The method of claim 12 further comprising connecting at least one additional panel to said second panel, wherein the first panel, second panel and the at least one additional panel are connected such that each of the panels are positioned spaced apart from each other by at least about 2 mm, and wherein a space is present between each of the adjacent connected panels such that the panels are separated by air.

17. The method of claim 12 further comprising attaching a rigid plate to a surface of said first panel, to a surface of said second panel, or to a surface of both said first panel and said second panel, where the rigid plate is attached only to a top outer surface of a series of panels and not to each individual panel of a series.

18. A reinforced object which comprises an object coupled with a ballistic resistant article, the ballistic resistant article consisting essentially of:

a) a first panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and b) a second panel connected to the first panel, the second panel comprising a plurality of fibrous layers, said plurality of fibrous layers being consolidated; each of the fibrous layers comprising a plurality of fibers, said fibers having a tenacity of about 7 g/denier or more and a tensile modulus of about 150 g/denier or more; each of said fibers having a surface, and the surfaces of said fibers being coated with a polymeric composition; and c) wherein the first panel and the second panel are adjacent to each other and are connected by a connector instrument such that they are positioned spaced apart from each other by at least about 2 mm, wherein each panel is connected to each adjacent panel by a connector instrument such that they are positioned spaced apart from each other by at least about 2 mm, and wherein a space is present between adjacent connected panels such that the panels are separated by air.

19. The reinforced object of claim 18 wherein said connector instrument is non-fabric and is positioned between and in contact with each of the adjacent panels, and wherein said connector instrument comprises at least one connecting anchor, or one or more spacing strips, or one or more extruded channels, or a frame, wherein each of the at least one connecting anchor, one or more spacing strips, one or more extruded channels or the frame both connect and space apart adjacent panels leaving a space between adjacent connected panels.

20. The reinforced object of claim 18 wherein said connector instrument comprises one or more spacing strips, one or more extruded channels, or a frame.

* * * * *